US006672519B2

(12) United States Patent
Hunter et al.

(10) Patent No.: US 6,672,519 B2
(45) **Date of Patent: *Jan. 6, 2004**

(54) AIR-ASSISTED, LOW PRESSURE SPRAY EQUIPMENT HAVING AN IMPROVED SPRAY NOZZLE

(75) Inventors: Jack H. Hunter, Coraopolis, PA (US); Terrell Dean Wayt, Moundsville, WV (US)

(73) Assignee: Bayer Polymers LLC, Pittsburgh, PA (US)

( * ) Notice: Subject to any disclaimer, the term of this patent is extended or adjusted under 35 U.S.C. 154(b) by 237 days.

This patent is subject to a terminal disclaimer.

(21) Appl. No.: 09/917,309

(22) Filed: Jul. 27, 2001

(65) Prior Publication Data

US 2003/0019953 A1 Jan. 30, 2003

(51) Int. Cl.[7] ..... B05B 1/28

(52) U.S. Cl. ..... 239/290; 239/288; 239/294; 239/600; 222/145.5; 222/145.6

(58) Field of Search ..... 239/288, 290, 239/294, 600; 222/145.5, 145.6

(56) References Cited

U.S. PATENT DOCUMENTS

| | | | | |
|---|---|---|---|---|
| 5,126,170 A | | 6/1992 | Zwiener et al. | 427/385.5 |
| 5,236,741 A | | 8/1993 | Zwiener et al. | 427/385.5 |
| 5,810,956 A | | 9/1998 | Tanis et al. | 156/71 |
| 6,488,991 B1 | * | 12/2002 | Hunter et al. | 427/421 |
| 6,572,031 B2 | | 6/2003 | Hunter et al. | 239/290 |
| 2002/0153433 A1 | | 10/2002 | Hunter | 239/290 |
| 2002/0170982 A1 | | 11/2002 | Hunter | 239/398 |

FOREIGN PATENT DOCUMENTS

DE 296 23 922 9/2000

OTHER PUBLICATIONS

Ratio–Pak® Cartridge System is manufactured by Plas–Pak Industries, Inc. (date unavailable).

130 Series, Spiral™ Mixer Sanitary design (date unavailable).

TAH Industries, Inc. Catalog 110, May 2000, Motionless Mixers for Adhesives and Sealants pp. 3–16.

Cox North America, Inc. (COX) Quality Sealant Applicators—Worldwide (date unavailable).

* cited by examiner

*Primary Examiner*—Robin O. Evans
(74) *Attorney, Agent, or Firm*—Joseph C. Gil; Gary Matz

(57) ABSTRACT

Air-assisted, low pressure spray equipment having an improved spray nozzle including a caulking gun having a carriage adapted to receive cartridges having a nozzle, rams mounted on the caulking gun for engaging each cartridge to dispense a liquid from the nozzle, a trigger mechanism for advancing the rams into operative engagement with each cartridge; a static mixer having an inlet port for receiving a liquid component from the nozzle of each cartridge and having an optional spray tip for introducing the mixed liquid components into an atomizing zone; a static mixer shroud encasing the static mixer and an optional spray section having inlet ports for receiving pressurized air and outlet ports for introducing air into the atomizing zone. The spray tip passes through an orifice in the spray section such that the mixed liquid components are introduced into the atomizing zone. The equipment is useful for spraying a two-component composition.

20 Claims, 2 Drawing Sheets

AIR-ASSISTED, LOW PRESSURE SPRAY EQUIPMENT HAVING AN IMPROVED SPRAY NOZZLE

BACKGROUND OF THE INVENTION

1. Field of the Invention

The present invention relates to air-assisted, low pressure spray equipment having an improved spray nozzle, which is especially suited for applying highly reactive, two-component coating, sealing or adhesive compositions, preferably two-component polyurea coating compositions.

2. Description of the Prior Art

Several types of spray systems are known for applying two-component coating compositions. If the two components are not highly reactive, it is possible to mix the two components prior to use and apply the systems with known one-component, airless or air-assisted spray systems. These systems are generally used with coating compositions having a pot life of one hour to several hours.

Preferably, the two-component compositions are applied with two-component spray systems, which may be either high pressure (more than 100 bar) or low pressure (less than 100 bar) systems. The high-pressure systems are usually airless or air-assisted airless spray systems. In these systems the two components are generally introduced under high pressure into a static mixer and are then passed through a spray tip under sufficient pressure to atomize the liquid. One disadvantage of these systems is their high cost.

Also suitable are low pressure or high-pressure impingement mixers in which the components are introduced through separate orifices into a mixing chamber and then pass through an atomization spray tip under fluid pressure. The mixing chamber is generally purged with a purge rod or pressurized air. Disadvantages of impingement mixing systems are their cost, difficulty to use and typical high-pressure requirements.

Examples of low-pressure systems for applying two-component compositions are air-assisted sprayers in which the components are premixed and then siphoned, passed by gravity or discharged from a pressure pot through an air atomization tip. Air is passed in a generally perpendicular manner to the mixed composition from opposing outlets to atomize the composition into the desired spray pattern. A disadvantage of these spray systems is that they are not suitable for spraying highly reactive two-component systems. Both during the spraying process and especially during stoppages, the components can react to form polymer solids that clog both the liquid spray tips and/or the air outlets. This causes a lengthy down time to clean the equipment for further use.

One alternative to prevent clogging in any of these low or high-pressure sprayers is to flush the equipment with a solvent or an air purge prior to stoppages. However, this embodiment results in higher equipment costs due to the presence of a third stream. In addition, the use of a solvent is disadvantageous both from a cost standpoint and an environmental standpoint.

It is an object of the present invention to overcome the disadvantages of prior art spray systems in a cost effective manner. It is an additional object of the present invention to provide an inexpensive, portable and efficient spray system for two-component, reactive compositions.

This object may be achieved with the low pressure, air-assisted spray system according to the present invention.

An important feature of the invention is the use of a disposable spray tip and static mixer to eliminate the clogging problems of prior art systems when spraying highly reactive two-component systems. Another important feature of the present invention is the use of an optionally power-assisted caulking gun to deliver the two-component composition to the spray tip.

Copending applications, U.S. Ser. Nos. 09/838,792 and 09/838,794 published as U.S. Published Application Nos. 200210153433 and 20020170982 respectfully, disclose the use of a disposable spray tip and static mixer in combination with a low pressure, two-component, air-assisted spray system. However, that system is intended for larger applications and does not disclose the use of a caulking gun to deliver the two-component composition. Copending application, U.S. Ser. No. 09/917,298 issued as U.S. Pat. No. 6,572,031, describes the use of a caulking gun to deliver two-component compositions to a static mixer having an optionally removable spray tip, but that application does not describe inserting the static mixer into a shroud.

SUMMARY OF THE INVENTION

The present invention relates to air-assisted, low pressure spray equipment having an improved spray nozzle including a) a caulking gun having a carriage adapted to receive two or more cartridges having a nozzle, two or more rams mounted on the caulking gun for operatively engaging each cartridge to dispense a liquid component from the nozzle of the cartridge, a trigger mechanism for manually, pneumatically, hydraulically or electrically advancing the rams incrementally into operative engagement with each cartridge, b) a static mixer having an inlet port on its upstream end for receiving a liquid component from the nozzle of each cartridge and having on its downstream end an optionally removable spray tip for introducing the mixed liquid components into an atomizing zone, c) a static mixer shroud, which encases the static mixer, is dimensioned on its upstream end for connecting the shroud to the cartridges of the caulking gun and has on its downstream end an optionally removable spray section having inlet ports for receiving pressurized air and outlet ports for introducing air into the atomizing zone, wherein the spray tip passes through an orifice in the spray section such that the mixed liquid components are introduced into the atomizing zone.

The present invention also relates to a process for spraying a two-component composition by a) activating the trigger mechanism of a caulking gun having a two or more rams and containing a two or more cartridges to incrementally advance a ram into operative engagement with each cartridge and dispense a first liquid component from a first cartridge and a second liquid component, which is reactive with the first liquid component, from a second cartridge into a static mixer having an optionally removable spray tip, b) mixing the first component and the second component in the static mixer, c) discharging the mixed liquid components from the static mixer through the optionally removable spray tip at the downstream end of the static mixer into an atomizing zone, d) introducing air into the atomizing zone, e) atomizing the mixed liquid components in the atomizing zone, f) spraying the atomized liquid components onto a substrate and g) during an interruption in the spraying process or after termination of the spraying process, discarding the static mixer and the optionally removable spray tip.

DETAILED DESCRIPTION OF THE INVENTION

Figure 1:
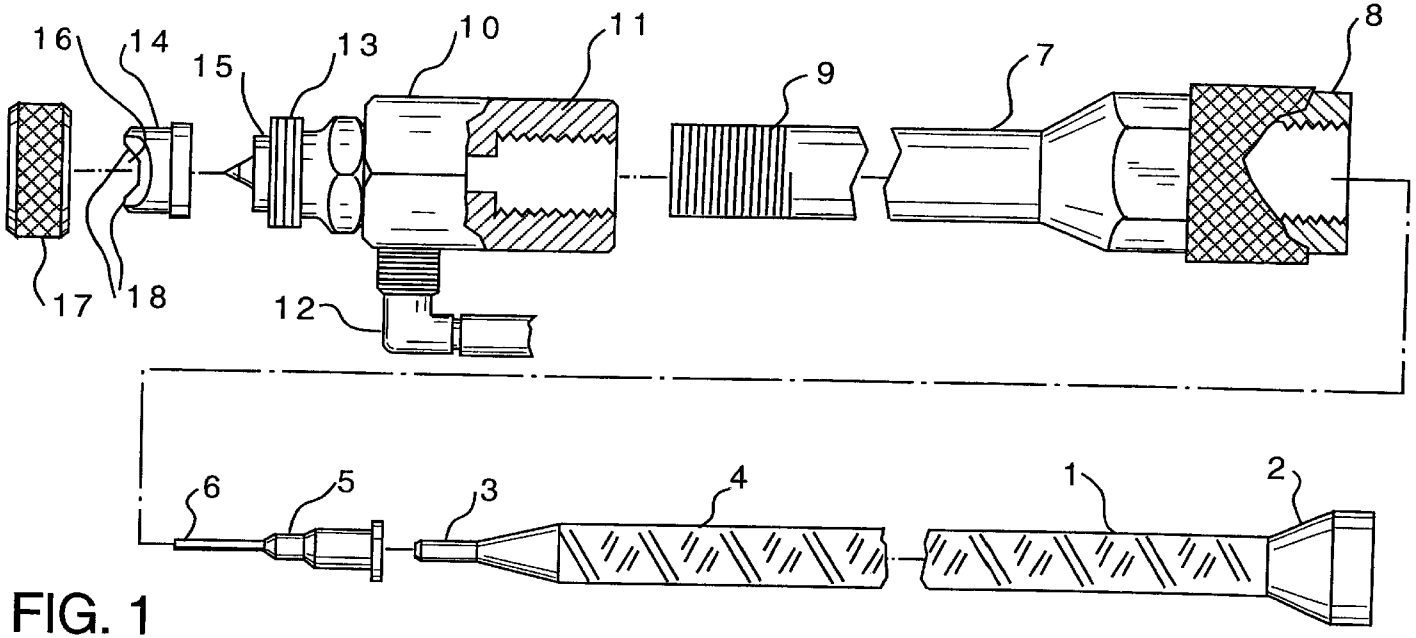
FIG. 1 represents an exploded view of a preferred embodiment of the spray nozzle according to the invention.

In accordance with the present invention it is possible to spray two-component compositions using a caulking gun. The caulking gun may be operated manually or preferably may be driven pneumatically, hydraulically or with an electric motor to more accurately and easily dispense two or more liquid components into a static mixer connected to the discharge end of the caulking gun.

The rams of the pneumatic or hydraulic caulking guns may be driven, e.g., by compressed air or a liquid such as water, which drives a piston connected to the ram. The rams of the electric caulking guns are driven by an electric motor, which either rotates a screw or worm drive to drive the ram. Any known caulking guns are suitable for dispensing the liquid components according to the present invention. Examples of manual and pneumatic caulking guns are available from Cox North America. One advantage of using pneumatic caulking guns is that the same compressed air source used to drive the ram can be used to provide air to the spray system to be described hereinafter.

When the caulking guns are used for dispensing materials from two or more cartridges, different mix ratios can be obtained by either using different size cartridges or by adjusting the rams for each cartridge to advance at different speeds, e.g., by using separate drive mechanisms. Another possibility for obtaining different mix ratios is to use more than one cartridge containing one of the liquid components. Preferably, different mix ratios are obtained by using different size cartridges for the components.

Examples of these cartridges include the Ratio-Pak cartridges from Plas-Pak Industries. Another advantage of these cartridges is that their nozzles are threaded and designed to be attached to the shroud of the disposable static mixers described hereinafter. When using two cartridges the two nozzles fit together to form a threaded end that can be attached to the disposable static mixer.

It is also possible in accordance with the present invention to overcome the problem of clogging in the static mixer, the spray tip and/or air entry ports when spraying compositions having a limited pot life, such as reactive two-component compositions, especially highly reactive two-component compositions. This is accomplished by using a removable static mixer having an optionally removable spray tip at the downstream end. In one embodiment the static mixer tapers at the downstream end to form a spray tip. In a preferred embodiment a removable spray tip is attached to the downstream end of the static mixer. In accordance with this preferred embodiment different size spray tips can be attached to control the volume of material to be sprayed.

The static mixers can be made of metal or plastic or other suitable materials. They are preferably made from plastic for cost reasons because at the completion of the spraying process or during periods when the spraying process is interrupted, the static mixer and the optionally removable spray tip are removed and discarded. Examples of suitable static mixers are available as motionless mixers from Tah Industries. Examples include plastic tube mixers and plastic bell nozzles. Removable spray tips are also available from Tah Industries as Luer needles. They are either prepared from plastic or a mixture of metal and plastic. The metal/plastic needles are preferred.

In accordance with the present invention the static mixer is inserted into a static mixer shroud. The upstream end of the shroud is dimensioned to be reversibly connected to the caulking gun, preferably to the cartridges inserted into the caulking gun. The type of connection is not critical, provided that the connection is reversible so that the shroud can be disconnected for discarding the static mixer and the optionally removable spray tip. Suitable connections include threads, clamps, retaining rings and quick connectors.

Figure 2:
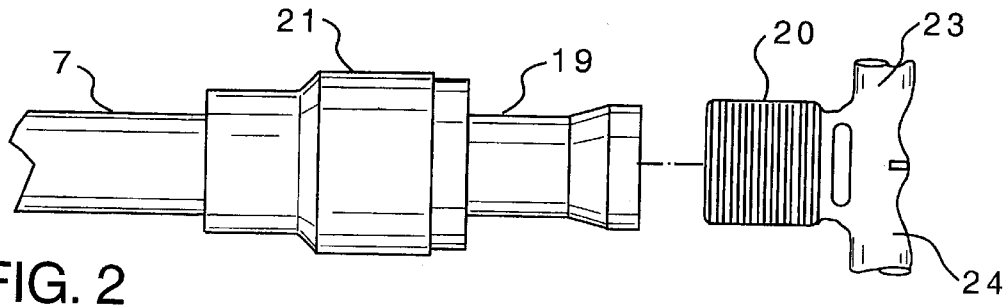
FIG. 2 represents another embodiment of the shroud according to the invention.

In one embodiment, which is shown in FIG. 1, the upstream end of the shroud is threaded so that it can be attached the threaded end of the cartridges extending from the caulking gun. In another embodiment, which is shown in FIG. 2, the upstream end of the shroud is flared so that it can be held against the cartridge(s) by a retaining ring, preferably a threaded retaining ring.

A conventional spray section having an atomizing zone is connected, preferably reversibly connected, to the downstream end of the shroud. In one embodiment the spray section is permanently connected or made as a part of the downstream end of the shroud. Preferably, the downstream end of the shroud is reversibly connected to the upstream end of the spray section using the same type of connections previously set forth for connecting the upstream end of the shroud to the caulking gun cartridge(s). The spray tip extends through an orifice in the rear portion of the spray section and into the atomizing zone.

Figure 4:
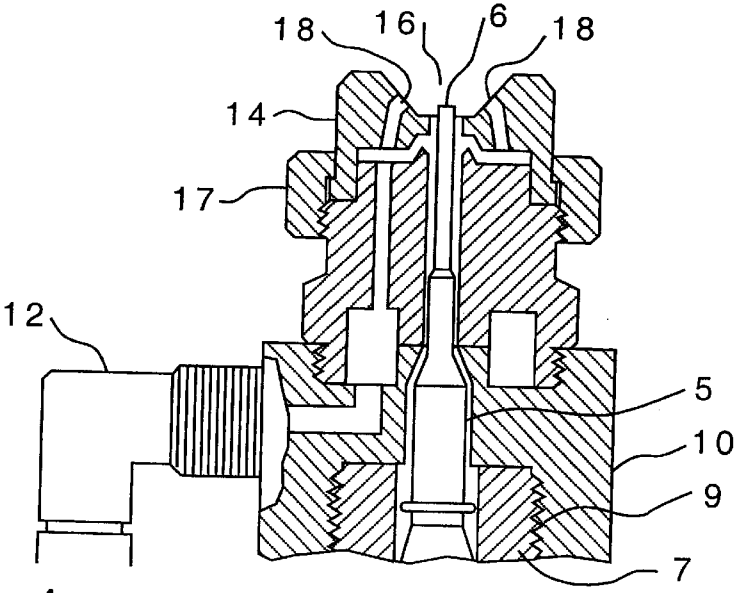
FIG. 4 represents an enlarged view of the spray section of the spray nozzle.

After the component(s) are mixed in the static mixer they are introduced into the atomizing zone of the spray section where they are atomized with air, which may stored in compressed gas cylinders or produced continuously in known manner in a compressor. Methods of atomizing the liquid component(s) with air for spraying are well known and are not critical to the present invention. In a preferred embodiment as shown in FIG. 4, the mixed liquid components are passed generally perpendicularly past two or more opposed air outlet ports. Depending upon the arrangement of these ports to the mixed components a flat or conical spray pattern can be controlled in known manner.

Air may also be introduced through the same orifice in the spray section that the spray tip passes through. In this embodiment the air passes on the outside of the spray tip parallel to the mixed components. However, less atomization occurs according to this embodiment. It is also possible to introduce air at other angles to the liquid components that range from parallel to perpendicular or slightly greater.

In accordance with the process of the present invention the liquid components are preferably introduced into the static mixer at a pressure of 2 to 100 bar, more preferably 5 to 70 bar, and most preferably 10 to 50 bar, which is supplied by the caulking gun. The components are then mixed in the static mixer and discharged through the optionally removable spray tip at the downstream end of the static mixer into an atomizing zone. Air is also introduced into the atomizing zone at a pressure of preferably 0.5 to 10 bar, preferably 1 to 7 bar and more preferably 3 to 6 bar. The atomized liquid components are then applied to a suitable substrate.

When spraying two-component compositions suitable first and second components include any compounds that are reactive with each other to form a polymer. Examples include the reaction of polyisocyanates with polyols to form polyurethanes, the reaction of polyisocyanates with polyamines to form polyureas and the reaction of epoxy resins or epoxidized urethanes with amine curatives to form polyamides. Examples of suitable components are well known. Preferred components are those that are highly reactive with each other, e.g. those that cure or react with each other within a few minutes to a few seconds. When spraying these types of components any interruption of the spraying operation results in clogging of the static mixer, especially the spray tip and occasionally the air inlets to the atomizing zone.

An example of highly reactive components are the polyisocyanates and polyaspartates described in U.S. Pat. Nos. 5,126,170 and 5,236,741, which are herein incorporated by reference.

Other additives, such as catalysts, solvents and pigments, may also be present in the cartridges. For example, they may be mixed with one of the two liquid reaction components. Alternatively, they may in separate cartridges, e.g., in a third cartridge. This is especially advantageous when spraying pigmented compositions. Generally, the pigment is mixed with one of the two liquid reaction components. However, when the pigment is present in a separate cartridge, it is easier to change the color of the composition since it is not necessary to maintain an inventory of each pigment blended with one of the reaction components.

FIG. 1 represents a preferred embodiment of the present invention. Static mixer 1 has a flared end 2 for receiving a one- or two-component composition and tapered end 3 for receiving removable spray tip 5. Static mixer 1 has internal mixing unit 4 for homogeneously mixing the one- or two-component composition. Spray tip 5 has an end 6.

Static mixer 1 and spray tip 5 are inserted through shroud 7 and spray section 10 such that end 6 extends into atomizing zone 16. Shroud 7 has threaded end 8 for attaching to the cartridge(s) of a caulking gun and threaded end 9 for connecting to spray section 10. When static mixer 1 is made from a plastic material, one of the purposes of shroud 7 is to prevent the static mixing from bursting due to the delivery pressure of the one- or two-component composition. Air is introduced into atomizing zone 16 via tube 12 through outlet ports in modified fluid nozzle 15 and through outlet ports 18 in air cap 14. Air cap 14 is held against the modified fluid nozzle 15 by attaching threaded retaining ring 17 to threads 13 of spray section 10. In atomizing zone 16, the air passing through outlet ports 18 atomizes the liquid stream of the one- or two-component composition passing through static mixer 1 and end 6 of spray tip 5.

FIG. 2 shows an alternative embodiment in which shroud 7 has a flared end 19 which is held against threaded end 20 of cartridges 23 and 24 of two-component caulking gun 22 by retaining ring 21.

Figure 3:
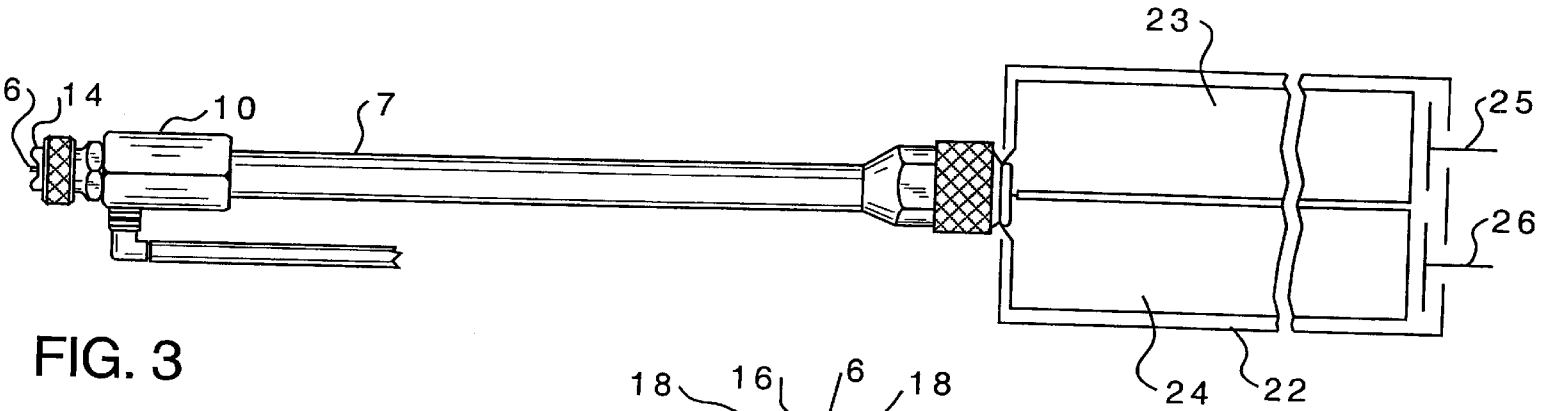
FIG. 3 represents an embodiment of the spray nozzle connected to the cartridges of a caulking gun.

FIG. 3 shows a preferred embodiment of the spray nozzle according to the invention that has been connected to cartridges 23 and 24 of two-component caulking gun 22. Components A and B, which are contained in cartridges 23 and 24, are delivered under pressure by rams 25 and 26 into static mixer 1 which has been inserted into shroud 7. Threaded end 20 of cartridges 23 and 24 are attached to threaded end 8 of shroud 7. Components A and B are mixed in static mixer 1 and then pass through spray tip 5 and end 6 into atomizing zone 16. The narrowed end 6 of spray tip 5 extends beyond the base of air cap 14.

FIG. 4 shows an enlargement of a preferred embodiment of spray section 10. Shroud 7 is connected to spray section 10 by threads 9. Spray tip 5 extends through spray section 10 such that end 6 passes through an orifice in air cap 14, which is held onto the end of spray section 10 by retaining ring 17. Air enters the upper portion of spray section 10 through tube 12 and passes through outlet ports in modified fluid nozzle 15 and through outlet ports 18 in air cap 14 into atomizing zone 16.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. Air-assisted, low pressure spray equipment having an improved spray nozzle comprising a) a caulking gun having a carriage adapted to receive two or more cartridges having a nozzle, two or more rams mounted on the caulking gun for operatively engaging each cartridge to dispense a liquid component from the nozzle of the cartridge, a trigger mechanism for manually, pneumatically, hydraulically or electrically advancing the rams incrementally into operative engagement with each cartridge, b) a static mixer having an inlet port on its upstream end for receiving a liquid component from the nozzle of each cartridge and having on its downstream end an optionally removable spray tip for introducing the mixed liquid components into an atomizing zone, c) a static mixer shroud, which encases the static mixer, is dimensioned on its upstream end for connecting the shroud to the cartridges of the caulking gun and has on its downstream end an optional spray section having inlet ports for receiving pressurized air and outlet ports for introducing air into the atomizing zone, wherein the spray tip passes through an orifice in the spray section such that the mixed liquid components are introduced into the atomizing zone.

2. The spray equipment of claim 1 wherein said spray tip is removable.

3. The spray equipment of claim 1 wherein an optional second liquid component is present.

4. The spray equipment of claim 2 wherein an optional second liquid component is present.

5. The spray equipment of claim 1 wherein said spray section in (c) is removable.

6. The spray equipment of claim 2 wherein said spray section in (c) is removable.

7. The spray equipment of claim 3 wherein said spray section in (c) is removable.

8. The spray equipment of claim 4 wherein said spray section in (c) is removable.

9. The spray equipment of claim 1 wherein said shroud is dimensioned to be threadably connected at its upstream end and its downstream end.

10. The spray equipment of claim 2 wherein said shroud is dimensioned to be threadably connected at its upstream end and its downstream end.

11. The spray equipment of claim 3 wherein said shroud is dimensioned to be threadably connected at its upstream end and its downstream end.

12. The spray equipment of claim 4 wherein said shroud is dimensioned to be threadably connected at its upstream end and its downstream end.

13. The spray equipment of claim 5 wherein said shroud is dimensioned to be threadably connected at its upstream end and its downstream end.

14. The spray equipment of claim 6 wherein said shroud is dimensioned to be threadably connected at its upstream end and its downstream end.

15. The spray equipment of claim 7 wherein said shroud is dimensioned to be threadably connected at its upstream end and its downstream end.

16. The spray equipment of claim 8 wherein said shroud is dimensioned to be threadably connected at its upstream end and its downstream end.

17. The spray equipment of claim 1 wherein said static mixer tapers to form a spray tip.

18. A process for spraying a one- or two-component composition which comprises a) activating the trigger mechanism of a caulking gun having a one or more rams and containing one or more cartridges to incrementally advance a ram into operative engagement with each cartridge and dispense a first liquid component from a first cartridge and a second liquid component, which is reactive with the first liquid component, from a second cartridge into a static mixer having an optionally removable spray tip, b) mixing the first component and the second component in the static mixer, c) discharging the mixed liquid components from the static mixer through the optionally removable spray tip at the downstream end of the static mixer into an atomizing zone, d) introducing air into the atomizing zone, e) atomizing the mixed liquid components in the atomizing zone, f) spraying the atomized liquid components onto a substrate and g) during an interruption in the spraying process or after termination of the spraying process, discarding the static mixer and the optionally removable spray tip.

19. The process of claim 18 wherein said first liquid component comprises a polyisocyanate and said second liquid component comprises a polyol.

20. The process of claim 19 wherein said first liquid component comprises a polyisocyanate and said second liquid component comprises a polyaspartate.

* * * * *